United States Patent [19]

Osthus et al.

[11] Patent Number: 4,840,123

[45] Date of Patent: Jun. 20, 1989

[54] CONVEYORIZED APPARATUS WITH MOVEABLE RAIL SECTION

[75] Inventors: Harold L. Osthus, West Willington; John F. de Raismes, Simsbury; Lawrence S. Wolfson, West Hartford; Robert M. Vaida, Ellington, all of Conn.

[73] Assignee: Gerber Garment Technology, Inc., Tolland, Conn.

[21] Appl. No.: 117,433

[22] Filed: Oct. 29, 1987

Related U.S. Application Data

[63] Continuation-in-part of Ser. No. 937,927, Dec. 4, 1986, abandoned.

[51] Int. Cl.[4] ..... E01B 25/24

[52] U.S. Cl. ..... 104/100; 104/102; 104/130

[58] Field of Search ..... 104/96, 100, 102, 103, 104/101, 130, 131

[56] References Cited

U.S. PATENT DOCUMENTS

| | | | |
|---|---|---|---|
| 1,750,802 | 3/1930 | Haferkorn | 104/100 |
| 4,615,273 | 10/1986 | Osthus et al. | 104/102 |

FOREIGN PATENT DOCUMENTS

| | | | |
|---|---|---|---|
| 2845473 | 4/1980 | Fed. Rep. of Germany | 114/96 |
| 2031468 | 11/1970 | France | 114/96 |
| 7512076 | 10/1975 | Netherlands | 114/96 |

*Primary Examiner*—Joseph F. Peters, Jr.
*Assistant Examiner*—Edwin L. Swinehart
*Attorney, Agent, or Firm*—McCormick, Paulding & Huber

[57] ABSTRACT

A conveyorized transport apparatus has an overhead rail system for transporting articles on a suspended trolley from one location to another. A moveable rail section in the system has a pivotal connection with an adjacent rail section to pivot the moveable section from a conveying position and a diverted position in which articles are delivered closer to a work station disposed laterally of the rail system.

16 Claims, 9 Drawing Sheets

CONVEYORIZED APPARATUS WITH MOVEABLE RAIL SECTION

The present application is a continuation-in-part of the previously filed U.S. application Ser. No. 937,927, filed 12/4/86, which is now abandoned.

BACKGROUND OF THE INVENTION

The present invention resides in a conveyorized transport apparatus having a rail system for transporting articles on a trolley between one location and another. More particularly, the invention is concerned with a pivotal rail section in a rail system which allows the transferred articles to be moved to a diverted position away from the conveying path.

A conveyorized transport apparatus utilizing an overhead rail system is known in the prior art and is used to transfer articles from one location to another. At least one prior art system is described in U.S. Pat. No. 4,615,273 having the same assignee as the present invention and is utilized in a garment plant to carry pattern pieces from one work station to another so that the pieces can be sewn together in a sequence of assembly steps to produce a garment such as a dress or suit. The rail system includes a main rail along which trolleys supporting the pattern pieces are moved by means of a pusher on a propulsion track. Subsidiary rail loops are located at each work station disposed along the main rail, and a switching arrangement is provided to divert the trolleys and pattern pieces to the appropriate work station. Once a work operation is performed on the pattern pieces at a work station, the trolleys and pattern pieces are returned to the main rail and advance to the next work station.

Such a conveyorized transport apparatus is computer-controlled to track each of the pattern pieces as the assembly operations progress and to direct the pattern pieces to and from the appropriate work stations.

Ideally at each work station, a seamstress should not have to move or reach very far to grasp the pattern pieces which are to be sewn. However, in the past, for the sake of moving the trolleys and supported pattern pieces through each work station without interference with the seamstress or other equipment, a reasonable separation was provided between the seamstress and the conveying path swept by the trolleys and the suspended pieces. A fair margin of safety was needed because various shapes and sizes of pattern pieces had to pass through a work station and, therefore, some reaching or movement on the part of seamstress was necessary.

It is, accordingly, a general object of the present invention to provide a conveyorized transport apparatus with a rail system which diverts the transported articles from the conveyor path and positions those articles within easy reach of personnel at a work station.

SUMMARY OF THE INVENTION

The present invention resides in a conveyor apparatus having a rail system for transporting a trolley and supported an article from one location to another.

The invention constitutes an improvement in the rail system and comprises a moveable rail section having oppositely disposed first and second ends and a pivotal connection with the adjoining rail section at the first end. The opposite second end is free to move horizontally and vertically because the pivotal connection with the adjoining rail section has two degrees of freedom.

Actuator means are connected with the moveable rail section for pivotally moving the second, free end relative to the first end by predetermined amounts. In this manner an article suspended from a trolley which moves onto the moveable rail section can be located away from the conveyor path and in a position which is more readily accessible by personnel in the work station.

DESCRIPTION OF THE PREFERRED EMBODIMENTS

Figure 1:
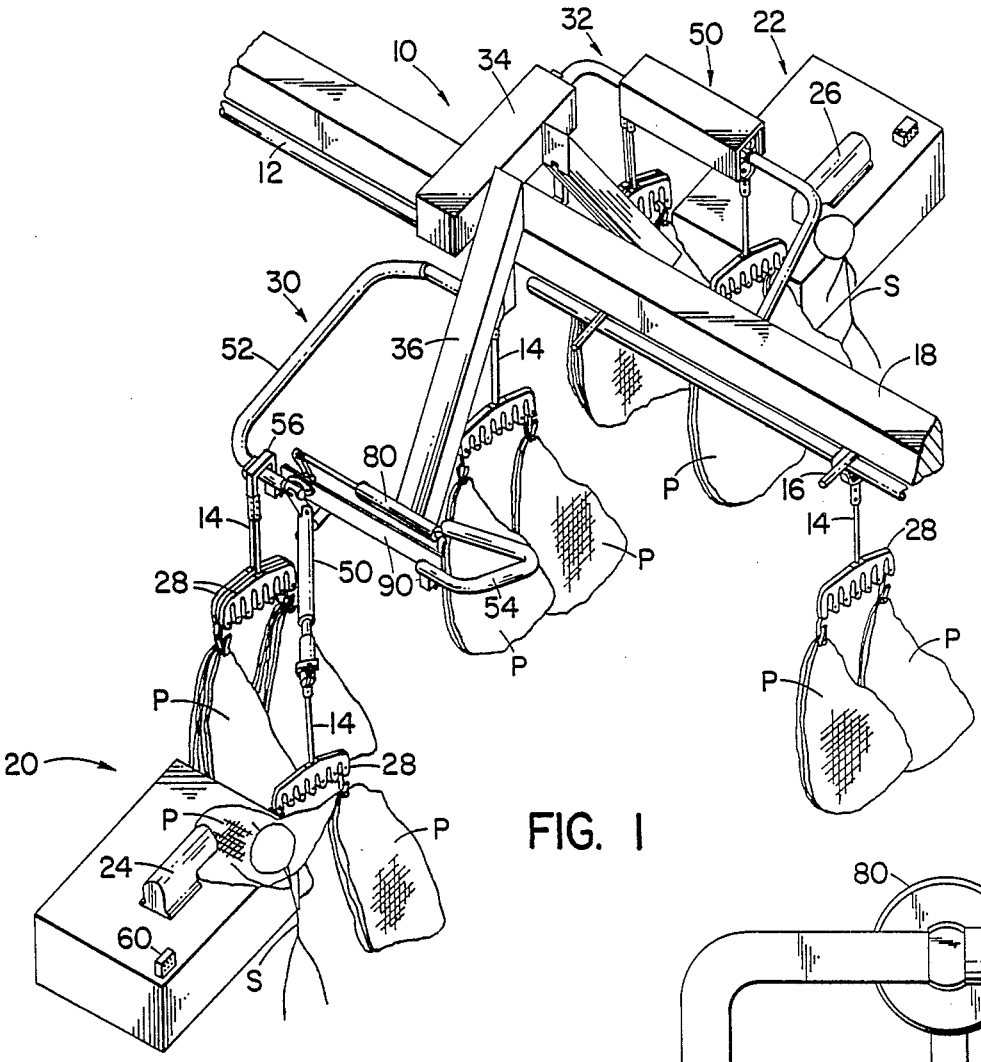
FIG. 1 is an overhead perspective view showing a fragment of a conveyorized transport apparatus which includes a first embodiment of the present invention and two laterally opposed work stations served by the apparatus.

FIG. 1 illustrates a conveyorized transport apparatus, utilizing a first embodiment of the moveable rail system, generally designated at 10, for transferring a plurality of articles, such as garment pieces P, from one location to another in a garment producing plant. The apparatus includes a rail system comprised by a main rail 12 along which trolleys 14 are propelled by means of pushers 16 that are moved by a propulsion track 18. As shown in FIG. 1, the main rail 12 passes between two laterally disposed work stations generally designated 20 and 22 where the garment pieces P are assembled by seamstresses S who operate sewing machines 24, 26 respectively. The trolleys 14 with the garment pieces P suspended on hangers 28 travel along the main rail 12 to a position adjacent a work station where selected pieces are to be used in the garment assembly operation. There the trolleys with the selected pieces are shifted by a switch 34 onto a subsidiary rail loop 30 or 32 and line up to await the seamstress S. Once the seamstress S is finished with the pattern pieces P, the associated trolley 14 and hanger 28 are returned to the main rail 12 by means of an elevator 36, and proceed to another work station for the next assembly operation.

A switching apparatus suitable for use as the switch 34 is defined and disclosed in greater detail is U.S. Pat. No. 4,615,273 referenced above.

In accordance with the present invention, each of the subsidiary loops 30 and 32 is provided with a moveable rail section to move a trolley 14 and suspended pattern piece P from the conveying path to a diverted position closer to and preferable within easy reach of the seamstress S. The subsidiary loop and moveable rail section at each work station are substantially identical and, therefore, the subsequent description is concerned solely with the loop 30 at the work station 20.

The subsidiary rail loop 30 includes a moveable rail section 50 adjacent the work station 20, an incoming rail section 52 for delivering the trolleys 14 and pattern pieces P to the work station from the main rail 12 and switch 34, and an outgoing rail section 54 for returning the trolleys and pattern pieces P back to the main rail 12 by means of the elevator 36. The incoming rail section 52 in a preferred embodiment has a generally downward slope from the switch 34 to a trolley stop 56 so that the trolleys and pattern pieces P move downwardly along the rail due to gravity and accumulate in sequence at the stop 56. The operation of the switch 34 and the determination of which trolleys 14 and pattern pieces P are distributed to the various work stations are all governed by computerized controls for the conveyorized transport apparatus 10.

Normally the moveable rail section 50 is positioned in registration with the incoming rail section 52 and the outgoing rail section 54, and may be inclined slightly like the other rail sections to allow the trolleys to progress away from the stop 56 when a trolley is released. The one end of the moveable rail section 50 has a pivotal connection with the incoming rail section 52, and the connection has two degrees of freedom to allow the opposite free end of the section 50 to move vertically and horizontally relative to the outgoing rail section 54 and the work station 20. When the seamstress S is prepared to work on a pattern pieces P suspended from the hanger 28 which is next in line at the stop 56, she actuates a release button on the control box 60 and the stop 56 allows only the one trolley and hanger to move from the incoming rail 52 onto the moveable rail section 50. At the same time the moveable rail section 50, which is pivotally connected to the end of the incoming rail section 52, pivots downwardly and laterally toward the work station and the trolley rolls down the rail section 50 to the lower end so that the suspended pattern pieces P can be easily reached and manipulated by the seamstress S. When the seamstress S is finished with the pattern pieces P, she actuates a return button on the control box 60, and the moveable rail section 50 with the trolley and assembled pattern pieces P returns to an elevated, conveying position in alignment with the outgoing rail section 54. The trolley 14 and pattern pieces P then advance to the elevator 36 and return to the main rail 12 by way of the outgoing rail section 54.

Figure 4:
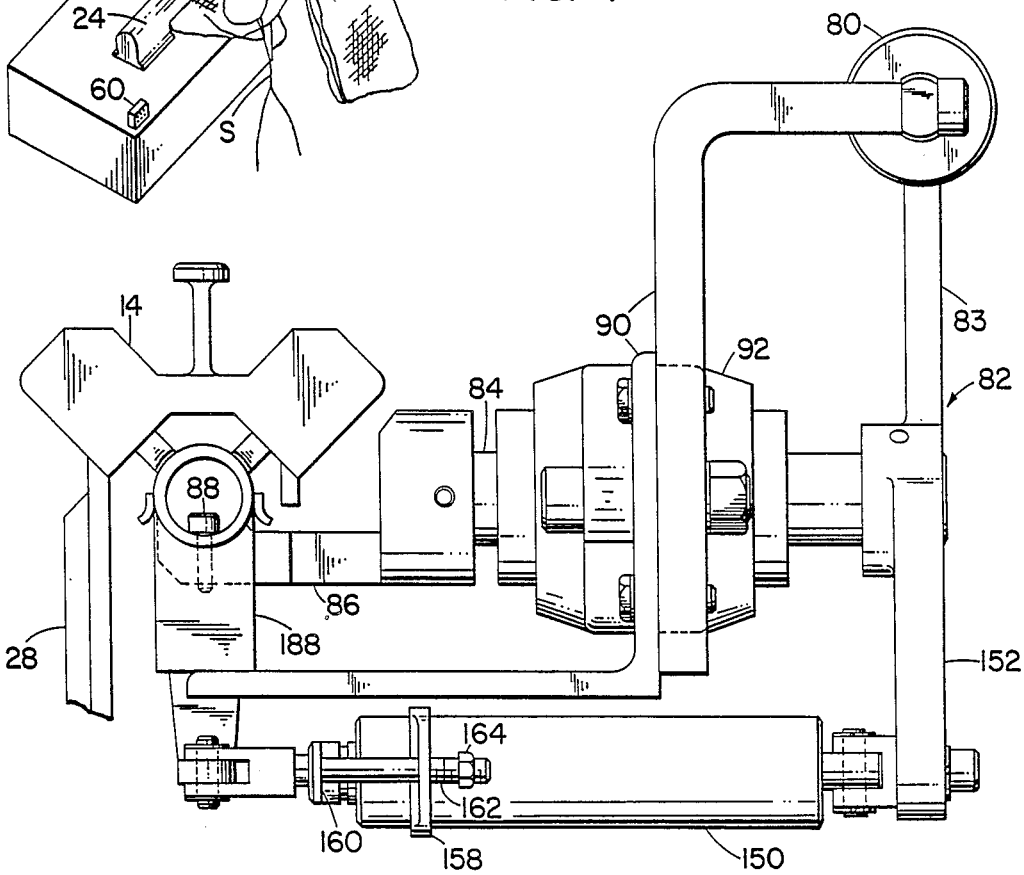
FIG. 4 is an end view of the first embodiment showing the moveable rail section and the actuators.
Figure 2:
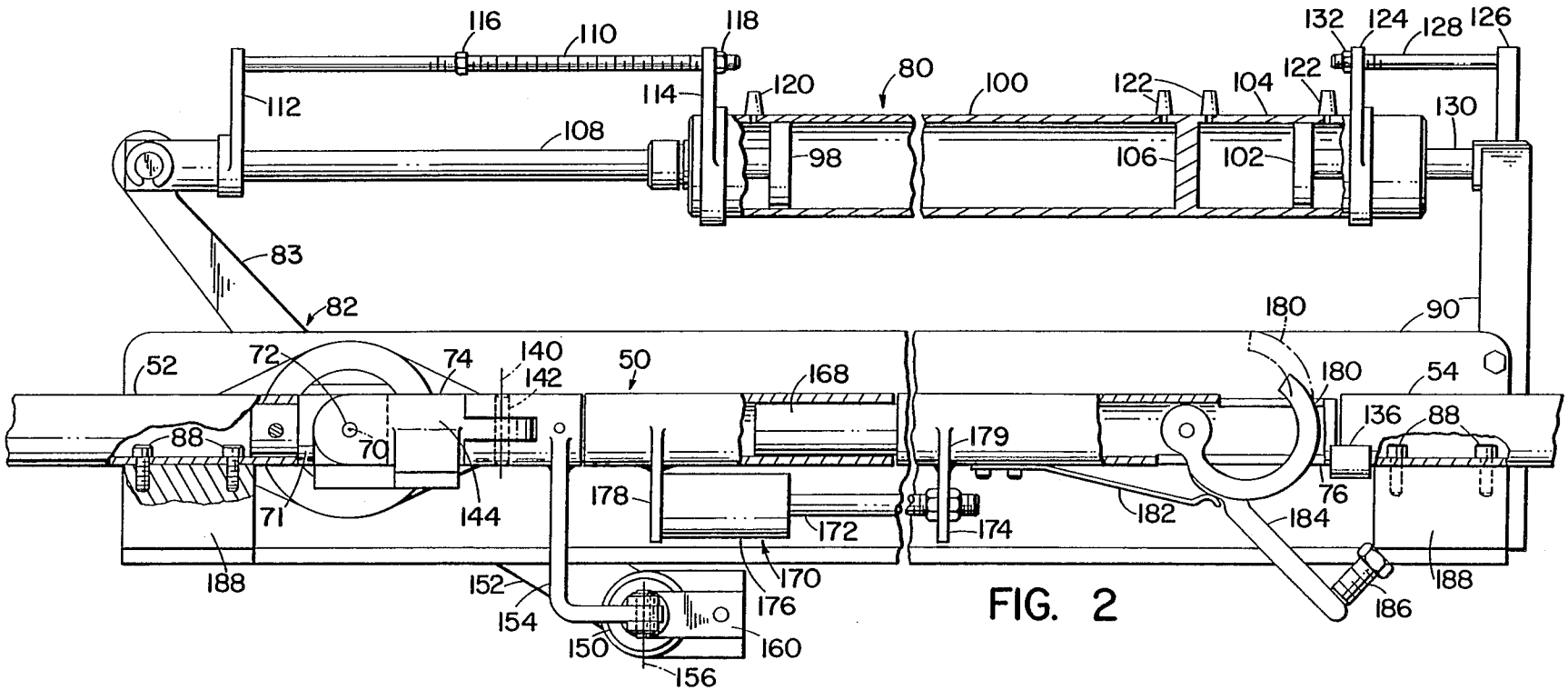
FIG. 2 is a side elevation view of the first embodiment showing a moveable rail section in the transport apparatus and the actuators which move the rail section.
Figure 3:
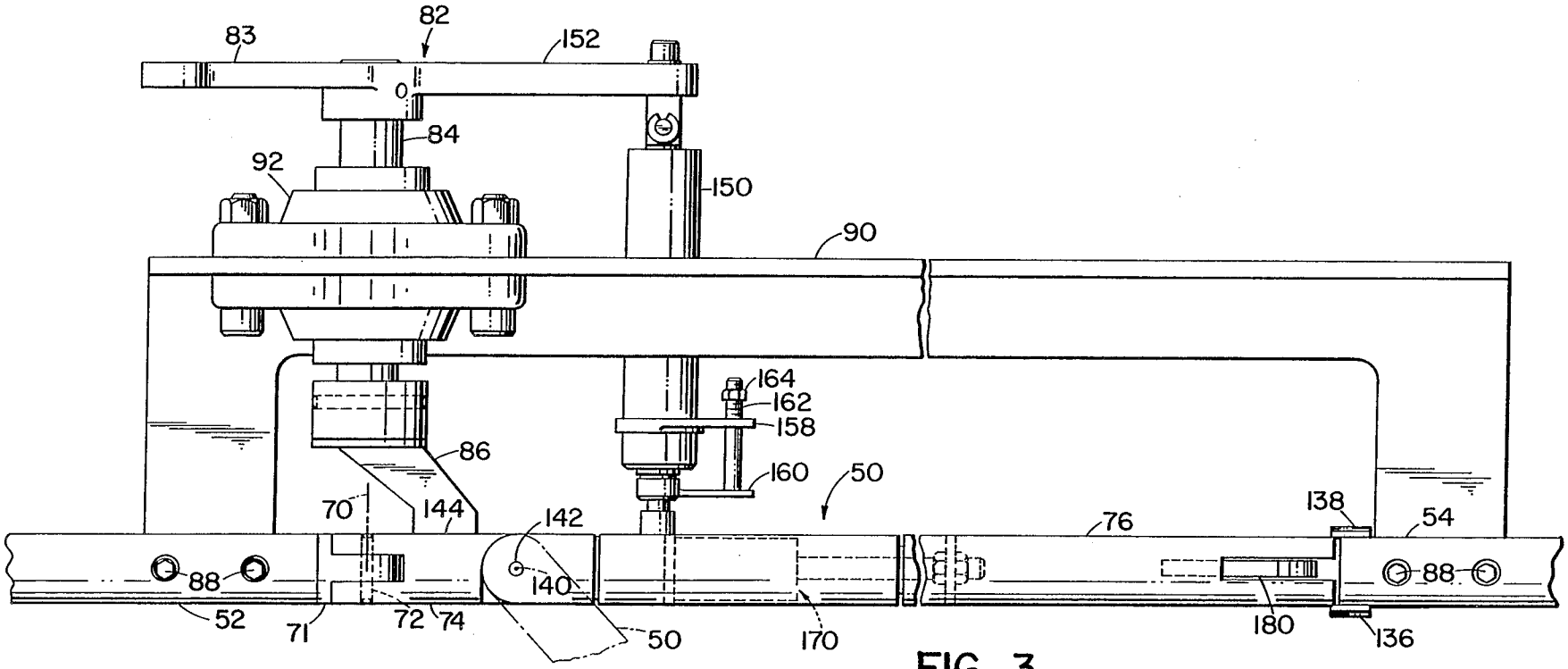
FIG. 3 is a top plan view of the first embodiment showing the moveable rail section with the vertical movement actuator removed.

The first embodiment of the moveable rail section 50 and its associated actuators is illustrated in detail in FIGS. 2–4.

As shown in FIGS. 2 and 3, the left end of the moveable rail section 50 has a pivotal connection at the left-hand end 74 with a connecting stub 71 of the incoming rail section 52. In the conveying position illustrated, the free, right-hand end 76 of the rail section 50 extends to a position adjacent to and in registration with the outgoing rail section 54. The pivotal connection is formed by a pin 72 at a pivot axis 70 and a pin 142 at axis 140. The pivot axis 70 is horizontal and hence motions about the axis allow the free end 76 to move vertically. To provide such vertical movement, a dual pneumatic actuator 80 is connected with the rail section by means of the upper arm 83 of bell crank 82, a torque shaft 84 which is coaxially positioned with the axis 70 of the pivot pin 72, and a torque arm 86. The arm is pinned to the shaft 84 at one end and cradles the rail section 50 at the other end and is secured to the rail section by means of a screw 88 as shown most clearly in FIG. 4. The torque shaft 84 is fixedly supported to an angular frame 90 by means of a journal bearing 92, and the frame member supports the moveable rail section 50 as well as the incoming rail section 52 and the outgoing rail section 54. The frame 90 serves as a bridging member between the incoming rail section 52 and the outgoing rail section 54 since the rail section 50 is not actually connected at its free end 76.

The pneumatic actuator 80 is a double stroke actuator and has a first piston 98 which reciprocates back and forth within a cylinder 100 and a second piston 102 which reciprocates back and forth within a cylinder 104. The cylinders 100 and 104 are serially connected and have a common cylindrical wall with a fixed partition 106 marking the boundry between the two cylinders. A piston rod 108 connects the piston 98 with the upper arm 83 of the bell crank 82, and the stroke of the piston is mechanically limited by means of an adjustable metering rod 110. The rod extends between an offset bracket 112 fixed to the end of the piston rod and an offset bracket 114 fixed to the end of the cylinder 100. The metering rod is fixedly secured to the bracket 112 and slides loosely through an aperture in the bracket 114. The rod is also threaded so that two adjusting nuts 116 and 118 can be moved to different positions on the rod to set the piston stroke.

When air is introduced into the cylinder 100 through the nipples 120 or 122, the piston 98 moves to one limit or the other of its stroke, and at the same time the bell crank 82 is rotated and the moveable rail section 50 is lowered or raised. By appropriate adjustment of the nuts 116 and 118, the upper position of the rail section can be made to coincide with the outgoing rail section 54 and the lower position can be set to most appropriately suspend a trolley 14 and pattern pieces P within reach of the seamstress S at the work station 20.

The other piston 102 and cylinder 104 have essentially the same construction as cylinder 100 and piston 98 except that the stroke of the piston is more limited. An offset bracket 124 is fixedly secured to the cylinder and an offset bracket 126 is secured to the end of the piston rod 130 connected with the piston 102. An adjustable metering rod 128 extends between the offset brackets and has an adjusting nut 132 to set the limits of the piston stroke.

The piston 102 and cylinder 104 of the double stroke actuator 80 are provided to allow the moveable rail section 50 to initially have a purely vertical movement between the flared guide plates 136, 138 adjacent the free end 76 of the rail section 50 at the beginning of a rail section movement away from the rail section 54 and at the end of the movement back into registration with the rail section 54. The piston 98 and the cylinder 100 are thus actuated in sequence with the piston 102 and cylinder 104 to control the total vertical movement and angle of declination of the moveable rail section 50.

The end 74 of the moveable rail section 50 is also pivotally connected with the incoming rail section 52 by means of the pivot pin 142 which extends in a direction generally orthogonal of the pivot pin 72. Together, the pivot pins 72 and 140 and the link 144 between the pins form a pivotal connection that provides two rotational degrees of freedom with respect to the incoming track section 52. The first degree of freedom about the pin 72 permits vertical movement of the free end 76 of the track section, and the second pin 142 permits generally horizontal movement of the free end.

A pneumatic actuator 150 extends between the lower arm 152 of the bell crank 82 and a control arm 154. The arm is connected to the lower side of the moveable rail section 50 longitudinally outwardly from the pivot pin 142. The pivot axis 156 between the foot and the actuator is longitudinally offset from the pivot pin 142 as most clearly seen in FIG. 3 so that the stroking of the actuator 150 causes the portion of the track section between the free end 76 and the pin 140 to swing generally horizontally as indicated by the solid and phantom positions of the rail section in FIG. 3.

The stroke of the pneumatic actuator 150 is also limited in the same manner as the actuator 80 by means of an offset bracket 158 secured to the cylinder, an offset bracket 160 secured to the end of the piston rod, an adjustable metering rod 162 and an adjusting nut 164.

The free end portion of the moveable rail section 50 is connected with the remaining base portion by means of a telescopic joint 168 shown in FIGS. 2 and 3 to allow the free end 76 of the rail section to be extended and retracted by means of another pneumatic actuator 170. The actuator 170 is suspended below the rail section 50 to allow trolleys 14 and their suspended hangers 28 to pass over the rail section without interference. The cylinder 176 of the actuator is fixedly connected to the base portion by means of an offset 178 and the piston rod is connected to the free end portion by means of an offset bracket 179. The stroke of the piston rod 172 can be fixed by the cylinder itself or can be adjusted by means of a metering rod in the same manner as the actuators 80 and 150.

The telescopic joint 168 and actuator 170 allow trolleys and suspended pattern pieces P at the free end 76 of the rail section 50 to be moved closer to the work station by extending the rail section beyond the length dictated by the spacing between the incoming rail section 52 and the outgoing rail section 54.

A spring loaded stop or hook 180 is pivotally mounted in the bifurcated end 76 of the moveable rail section 50 in order to engage and hold trolleys which roll down the rail section when the rail section is pivoted into the diverted position adjacent the work station. Thus the trolleys and the suspended garments remain captured at the end of the rail section and are prevented from rolling off.

The hook 180 is urged into an uppermost position between the furcations of the end 76 by means of a leaf spring 182 as shown in FIG. 2. To allow the trolleys and pattern pieces P to advance beyond the end 76 when the moveable rail section 50 and the outgoing rail section 54 are in registration, a retracting lever 184 integrally connected with the hook 180 engages an adjustable stop pin 186 in stop block 188 as the section end 76 is brought into its position of registration with outgoing rail section 54. The lever retracts the stop hook 180 from its phantom position and holds the hook in the solid line position as shown in FIG. 2. Sufficient clearance exists between the trolleys and the hook in its retracted position to allow the trolleys and suspended pattern pieces P to pass freely along the conveying path between the track sections 50 and 54.

Figure 5:
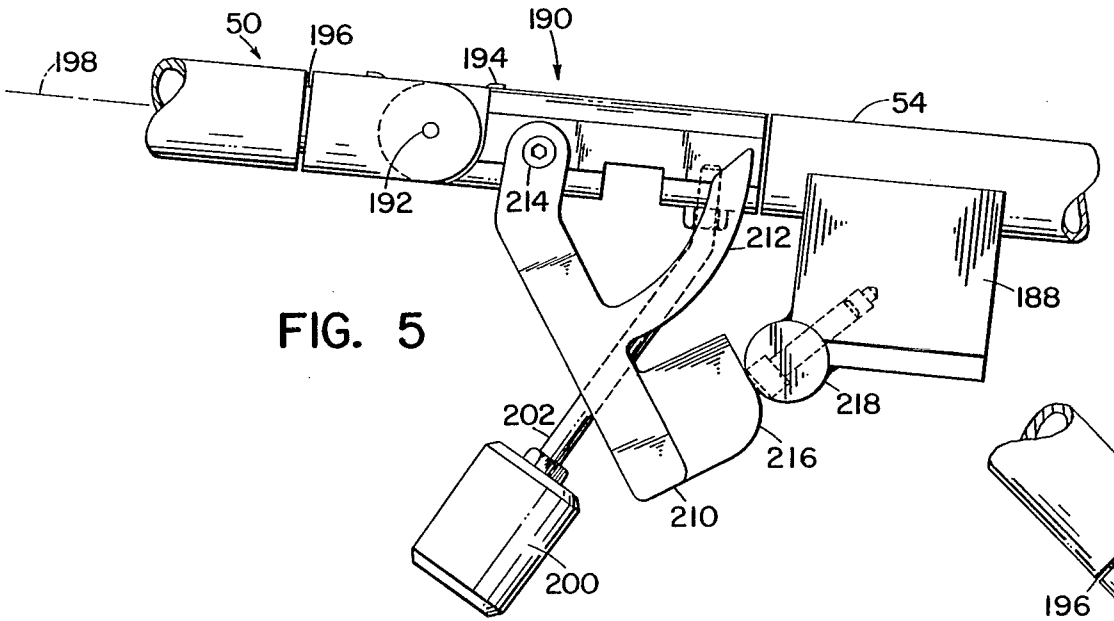
FIG. 5 is a fragmentary view showing an alternate embodiment of the free end of the moveable rail section used in the first embodiment, in its conveying position adjacent the adjoining rail section.
Figure 6:
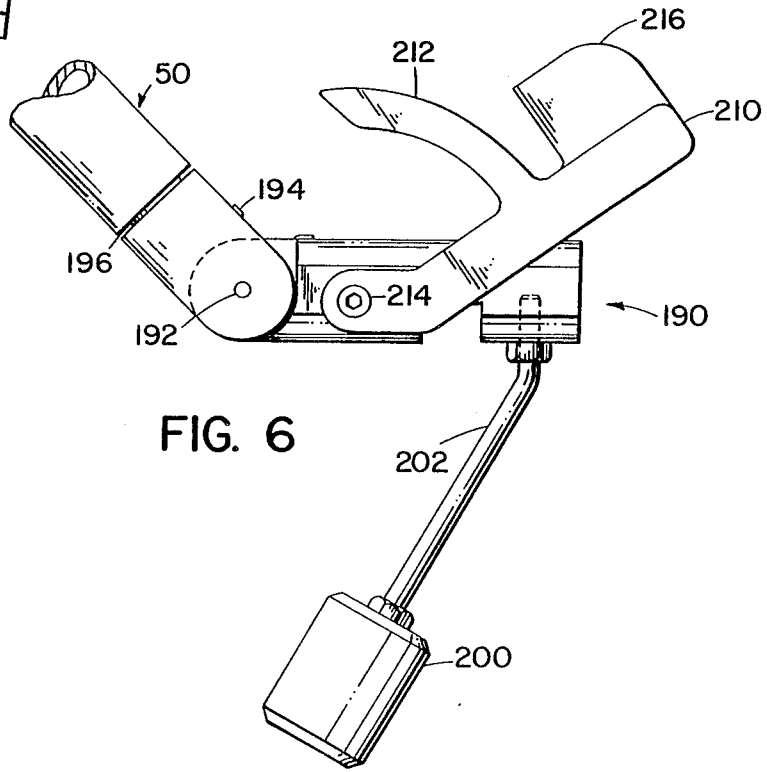
FIG. 6 is an other fragementary view showing the alternate embodiment shown in FIG. 5 of the free end of the moveable rail section in the diverted position.

An alternate embodiment of the free end of the moveable track section 50 used in cooperation with the first embodiment is illustrated in FIGS. 5 and 6. The free end 190 is pivotally connected to the remaining portion of the rail section 50 by means of a pin 192 and is resiliently biased against a stop block (not visible) by means of a coil spring 194 to hold the end 190 generally in axial alignment with the remaining portion of the rail section 50.

The end 190 also has a swivel joint 196 which allows the end to rotate relative to the rest of the rail section about the longitudinal axis 198. The swivel joint is desireable with the pivot pin arrangement illustrated in FIGS. 2 and 3 because the joint allows the end 90 to maintain the pin 192 in a horizontal orientation when the remaining portion of the rail section 50 is pivoted about the pin 142 and the rail section is in an inclined attitude. In such an attitude the pin 142 is not vertical and therefore the pivoting motion about that pin is accompanied by a slight rotation about the longitudinal axis of the section.

To maintain the portion 190, and more particularly the pin 192 in a horizontal position, a bob weight 200 is suspended below the end by means of a lever rod 202. Any inclination of the pin 192 is consequently accompanied by a restoring torque due to the pendulous position of the bob weight. The maintenance of the horizontal position of the end is desireable to ensure that the wheels of the trolleys 14 engage the smooth upper surface area of the rail, and that the trolleys do not become ensnared with other parts of the rail section such as the stop latch 210 described below.

The bob weight 200 also assists in holding the end 190 in a generally horizontal position when the remaining portion of the moveable rail section 50 is in a steep declination angle as shown in FIG. 6. The bob weight 200 attempts to maintain the position generally below the pivot pin 192 and, in doing this, opposes the coil spring 194 and maintains the end 190 in a generally level position. A level position is desireable since it allows the stop latch 210 to hold an engaged trolley in a secure manner.

The stop latch 210 performs the same basic holding function as the latch 180 in the embodiment of FIGS. 2 and 3. However, the stop latch is comprised by two hooks 212 (only one visible) disposed at each lateral side of the end 190 and pivotally connected with the end by means of pin 214. A contact block 216 is interposed between the two hooks 212 and engages the contact dowel 218 on stop block 188 when the moveable rail section 50 is moved into registration with the rail section 54 as shown in FIG. 5. In this condition, the hooks 212 are retracted to a lower position and a trolley is free to pass by gravity between the sections 50 and 54.

Figure 7:
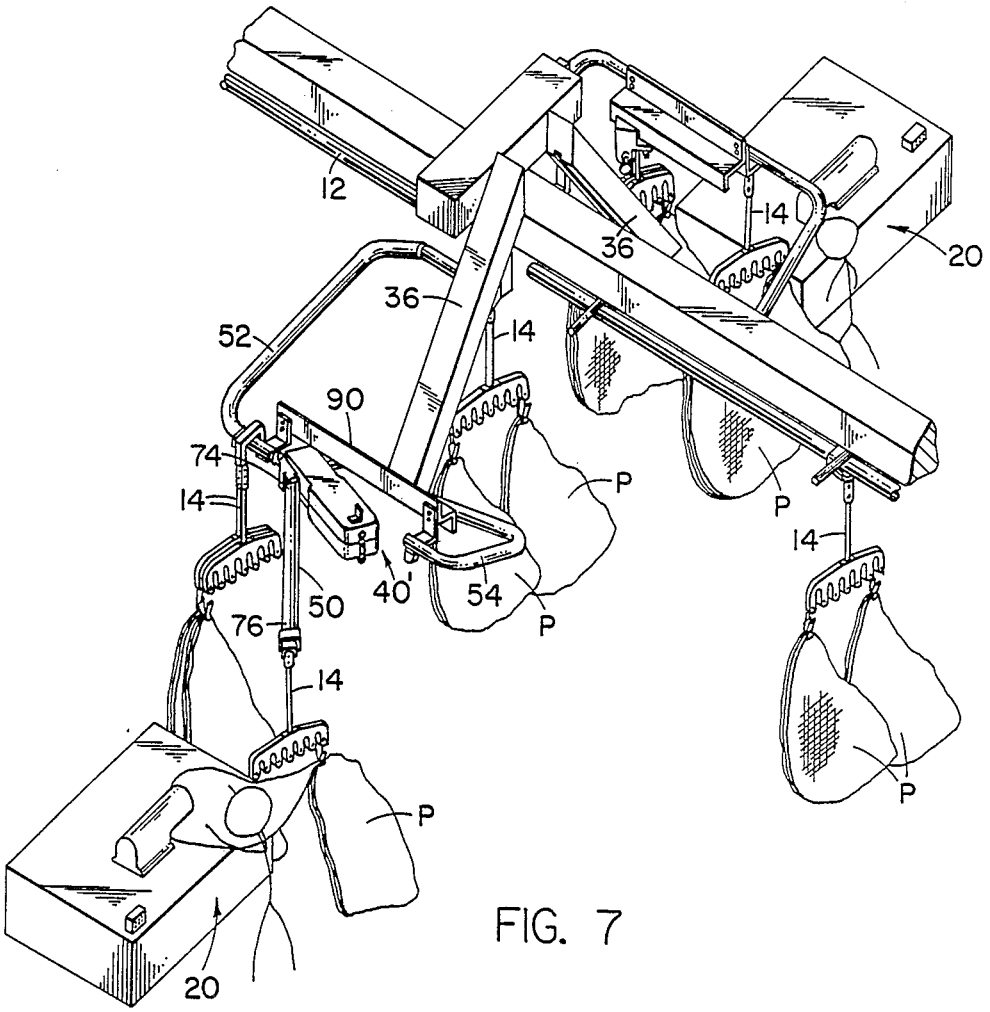
FIG. 7 is in overhead perspective view of a second embodiment of the conveyorized transport apparatus.

FIG. 7 illustrates a conveyorized transportation apparatus using a second embodiment of the moveable rail system for transferring a plurality of articles, such as garment pieces P, from one location to another in the garment producing operation as has previously been discussed. This apparatus includes the same incoming rail section 52 for delivering trolleys 14 to the work station, as well as outgoing rail 54 for returning the trolleys back to the main rail 12 by means of elevator 36. As shown in FIG. 7, the moveable rail 50 can be cooperatively mounted with the vertical actuator so that both the actuator and the rail pivot in unison, with respect to the fixed incoming rail 52. FIG. 7 further illustrates the alternate arrangement of the pivot joints to accomplish non-rotatable translation of the free end of moveable rail member 50 as it is being lowered to work station 20.

Figure 8:
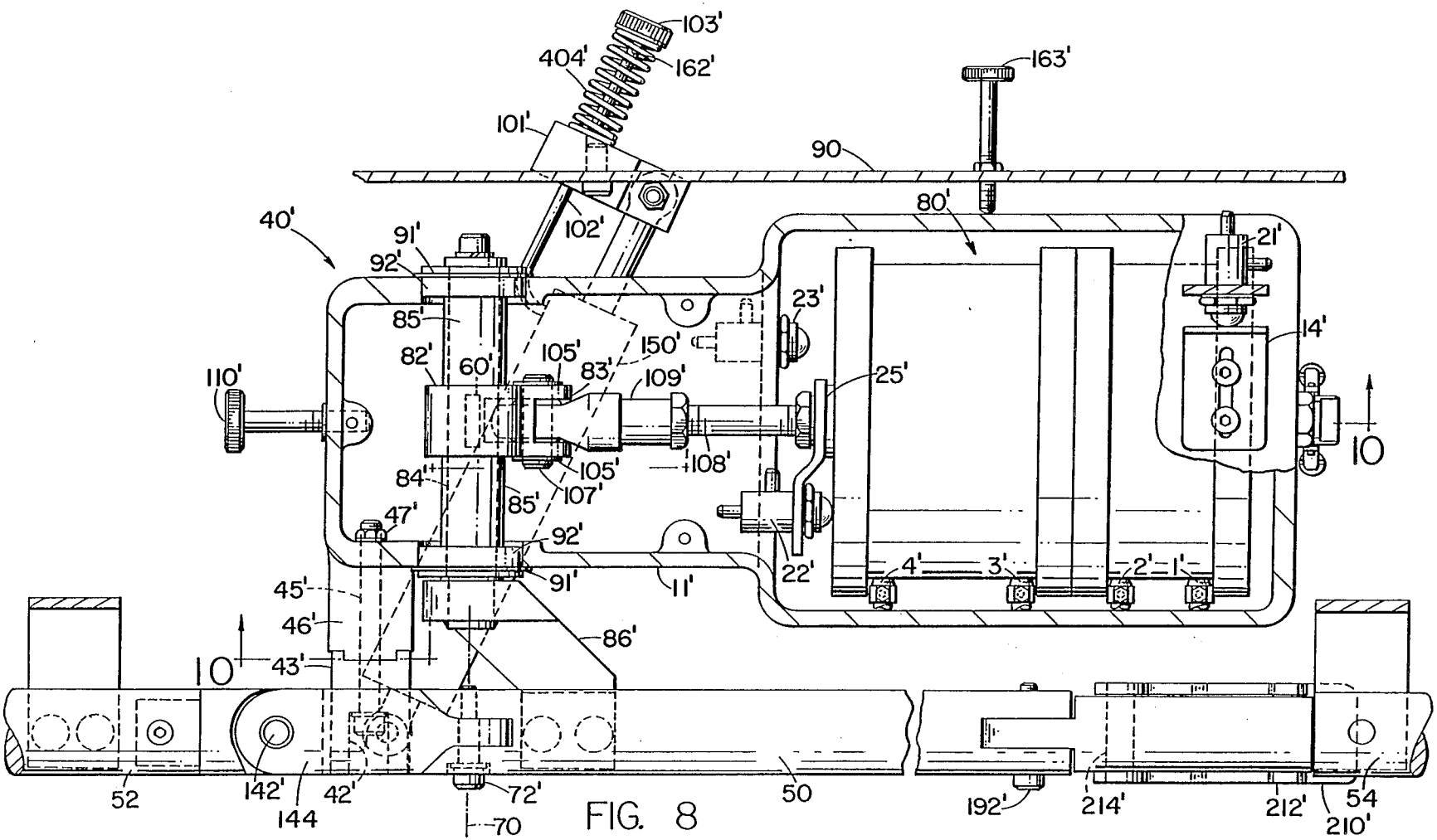
FIG. 8 is a horizontal sectional view, taken on line 8—8 of FIG. 10, showing the actuator mechanism of the second embodiment.

FIG. 8 illustrates the actuator and moveable rail assembly of the second embodiment. As can be seen from this figure, the actuator assembly, generally represented by numeral 40', is fixedly attached with the moveable rail member 50 in a parallel spatial relationship. Spacer member 46' non-rotatably fixes the end of the actuator assembly to the side-face 43' of link member 144'. Side-face 43', is correspondingly cut-out in order to mate with the cut-out face of the spacer 46'. Apertures 42' are made in the side-face of link 144' and in alignment with apertures in spacer 46' to receive bolts 45'. Thus, when nuts 47' are threaded onto the ends of bolts 45', the cut-out face 43' of link member 144'' is locked in axial retention within the stepped portion of the spacer 46' to provide an anti-rotational joint between the link and the actuator assembly.

Figure 9:
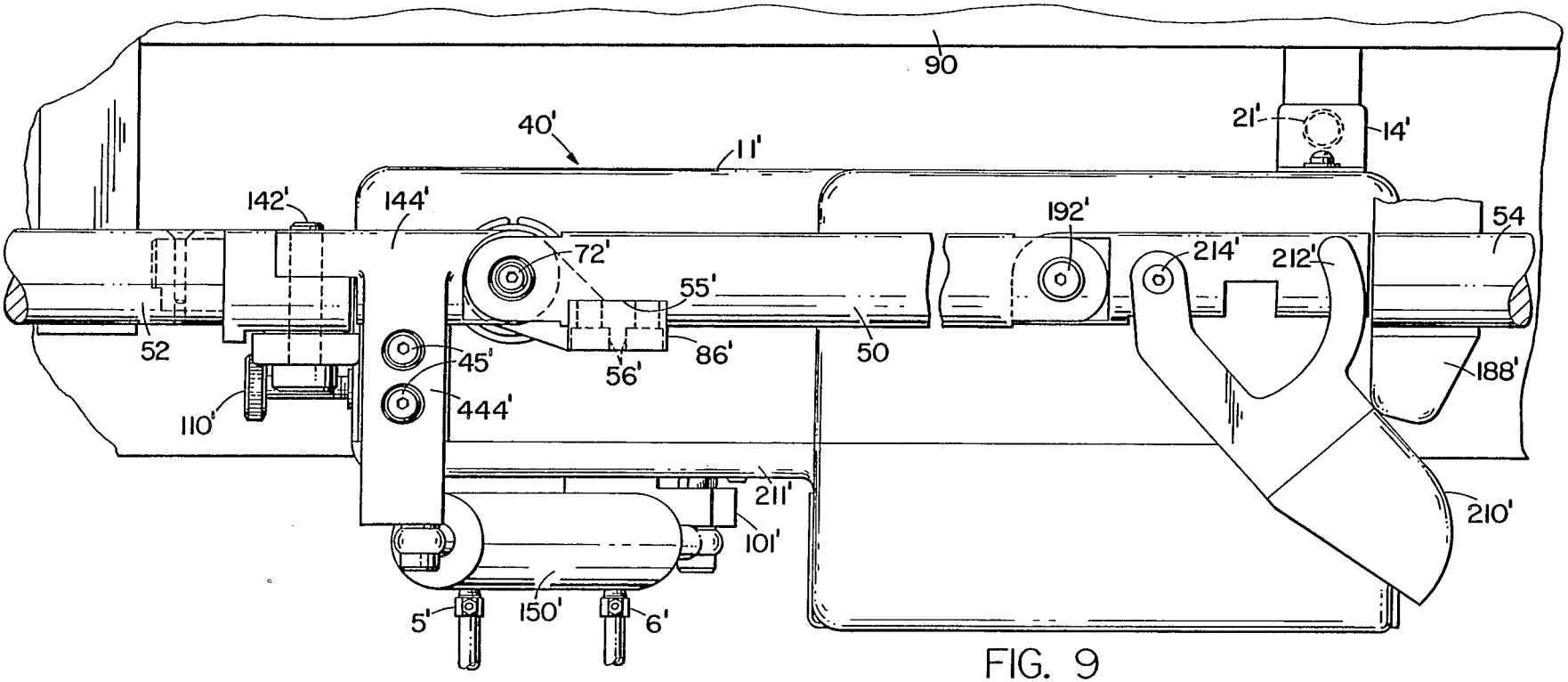
FIG. 9 is a side elevation view showing the moveable rail attached to the actuator in the second embodiment.

Link 144' can attach the actuator assembly 40' and the moveable rail member 50 to either the incoming rail 52 or the outgoing rail 54. As shown in FIGS. 8 and 9, the end of link 144', which is opposite the end that pivotally connects to movable rail 51, supports the entire actuator and moveable rail assembly through its connection with the end of the incoming rail 52. One way of effecting this connection is to telescopically insert a portion of the link end within the rail section and to secure this end by a suitable attachment means. Generally, link 144' enables moveable rail member 50 to possess two degrees of freedom as was the case with the first embodiment. However, in the second embodiment, the arrangement of the pivotal joints is reversed. Vertical pin member assembly 142' is arranged firstly on link member 144' to allow a horizontal movement of both the rail 50 and the actuator assembly 40'. The pin 72' is secondly arranged on link 144' to enable only the moveable rail 50 to move in a vertical sense. As can be seen from FIG. 9, one benefit of this arrangement of the pivot pins is that the horizontal actuating cylinder 150' can be arranged to operate in a single plane, rather than being swung in a vertical arc as is done in the first embodiment. The moveable rail 50 is, thus, the only member which swings a vertical arc with respect to the actuator assembly.

Figure 10:
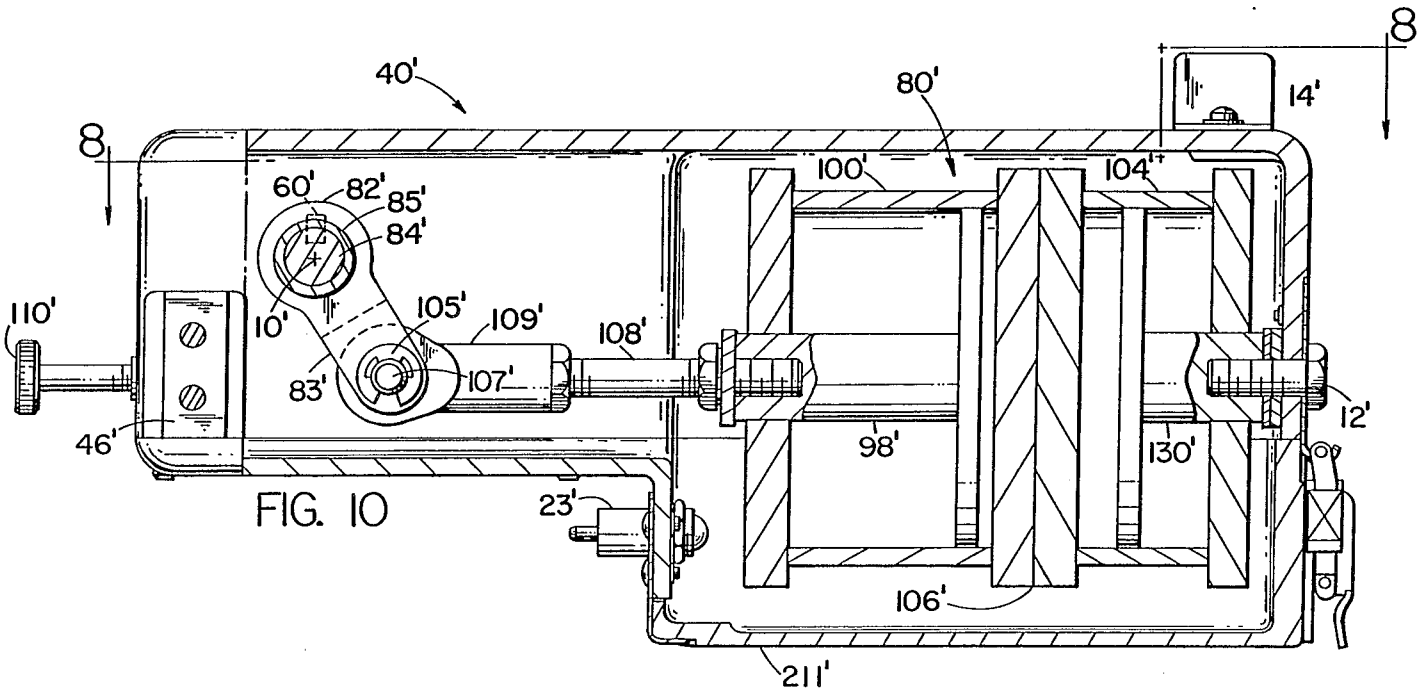
FIG. 10 a vertical sectional view, taken along the line 10—10 of FIG. 8 depicting the inner mechanism of the actuator assembly.

The vertical movement, which is imparted to rail 50, is generated by the pressurization of the dual cylinder pneumatic actuator 80' as shown in FIG. 8. The actuator structure 80', in response to this pneumatic pressure, actuates piston rod 108' to axially move connecting rod member 109', to thereby impart a rotation to torque shaft 84' via crank 82'. As can be seen from this figure, the crank 82' comprises, at one end, a bifurcated arm structure 83' sized and shaped to receive a correspondingly shaped end portion of connecting rod 109'. The arm members, 83', as well as the connecting rod 109', have a co-axial aperture placed therein which receives, in alignment, connection pin 107'. Connection pin 107' is retained from axial displacement by split retaining rings 105'. The other end of crank 82', as can be seen in FIG. 10, possesses, in cross-section, a through bore which receives torque shaft 84' housed within this bore. In a similar manner, torque sleeve members 85', telescopically receive torque shaft 84' therein to thereby serve as a spacing means. Key member 60', rigidly connects the crank 82' and the torque shaft 84', in a rotation transmitting manner. Thus, it can be be seen from FIG. 10, that the line of action of the piston rod 108' and connecting rod 109', is offset from the axis of rotation 10' of the torque shaft 84', to thereby create a turning moment on the torque shaft through the moment arm created by the crank 82'.

The torque shaft 84', and the torque sleeve members 85', as well as the crank 82', are held in a fixed aligned position by the cooperation of key member 60' and by the cooperation of journal bearing means as shown in FIG. 8. Journal bearings 92', are closely fit within aligned apertures made in the actuator housing, 11'. The journal bearing members 92' are prevented from movement into the housing by the outer retaining rings 91' which are circumferentially mounted around the journal bearing members. The torque shaft 84' is received within aligned apertures in journal bearing members 92'. However, the torque sleeve members 85' are sized so that the respective outer ends of the sleeves simply abut the respective inner faces of the journal bearings to internally space these members. As can be appreciated from FIG. 8, outer retaining rings 91', prevent any lateral movement of the shaft assembly because they are held in rigid spaced orientation by the torque sleeve members 85'.

The rotation, which is ultimately imparted to torque shaft 84', is transferred to the moveable rail arm 50 by the torque arm 86'. One end of the torque arm, 86', is mounted on torque shaft 84' in a non-rotational manner by suitable attachment means, such as the weld shown in FIG. 8 or, for example, a transverse pin type connection. The other opposite end of torque arm 86', is sized and configured to be received within cut-out portion 55', in the moveable rail section 50. Screws 56', or other suitable attachment means, are used to connect the other end of the torque arm, 86', to the moveable rail section 50. The position of this connection between the torque arm and moveable rail 50 is so arranged as to be spaced substantially from the pivot axis 70', in order to effectively provide a lifting or lowering moment to moveable arm 50.

As has been previously discussed, both the actuator assembly 40' and moveable rail 50 are unitarily connected, one with the other, through link member 144'. Since the vertically oriented pin assembly 142', allows for the horizontal pivotting of link 144' and those parts connected therewith, attachment of a horizontal actuator means to a point on this link will accomplish horizontal movement of those connected members. As shown in FIG. 9, link 144' has a vertically downwardly depending portion, 444', which provides for a pivotal attachment means at its end for connection with one end of the horizontal actuator assembly 150'. The other end of the horizontal actuator assembly 150', is pivotally mounted to support block 101'. Support block 101' is fixedly attached to frame member 90. Used in conjunction with horizontal actuator 150' is a retaining member 102' which also is attached with mounting block 101'. The retaining member acts to absorb the momentum of the assembly as it swings to a stop by incorporating spring member 404' between the adjustable stop 103' to so absorb the excess energy. It can be appreciated that because the end of the retaining member 102' is threaded at 162', in FIG. 8, the arc in which the moveable rail assembly is moved outwardly, is controlled by the operator's adjustment of stop nut 103'. Conversely, it can be appreciated that the arc in which the assembly is allowed to swing back inwardly, is controlled by the adjustment of metering bolt 163'. Since metering bolt 163' is attached with frame 90, the metering bolt will abuttingly space the actuator housing 11' from the frame 90 in order that the attached moveable frame member 50 will be in axial alignment with the fixed outgoing rail section 54.

Figure 12:
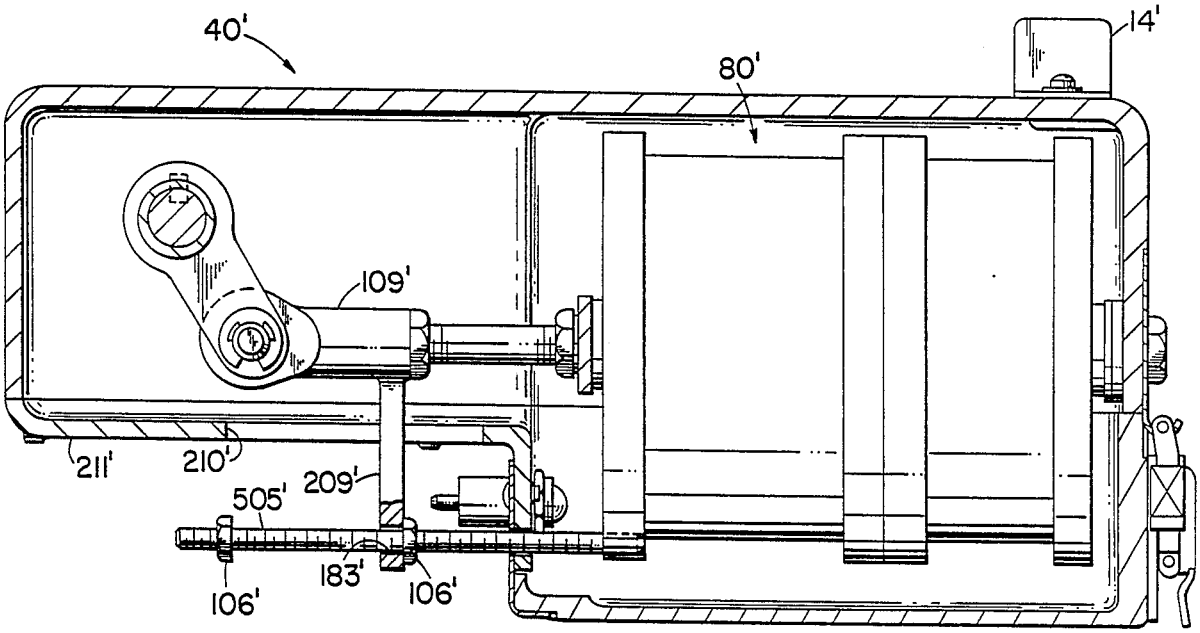
FIG. 12 is a vertical sectional view taken along the line 10—10 of FIG. 8 but showing an alternate stop mechanism for vertically adjusting the rail member.

Likewise, the vertical arc, which is swept by the moveable rail 50 can be be adjustably controlled, either by the use of metering bolts 110', as shown in FIGS. 8 and 10, or alternatively by the limiting structure shown in FIG. 12. The metering bolt 110', of FIGS. 8 and 10, is threadedly engaged with actuator housing assembly 11', to provide an adjustable, yet fixed, stop surface for the end face of connecting rod member 109' to abut. In the alternative embodiment of FIG. 12, connecting rod assembly 109' possesses a downwardly extending rod extension 209', which projects through cut-out 210' made in the lower housing element 211', in order to co-act with a stop limiting assembly which is fixedly attached to the dual actuator structure 80'. The lower free end of rod extension 209' possesses a through aperture 183', which is sized to receive threaded rod 505' in a non-engaging manner. The movement of connecting rod 109' is, therefore, limited by the placement of nut members 106', along the threaded rod 505' to thereby control the arc by which moveable rail member 50 swings.

Figure 11:
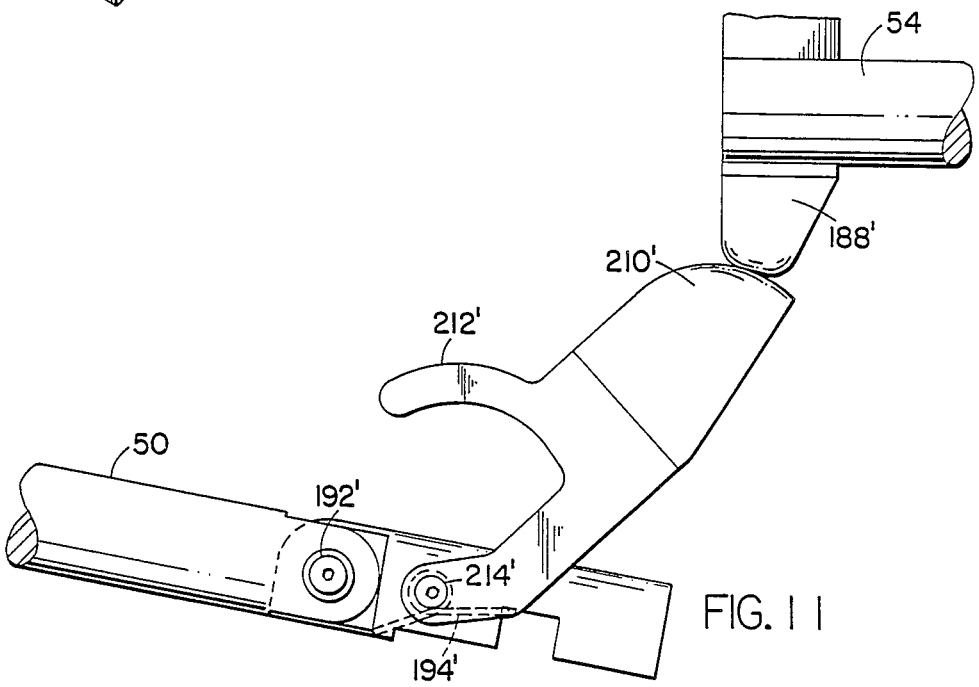
FIG. 11 is a side view of the free end of the moveable rail as it is used in the second embodiment of the invention.

Referring now to FIG. 11, which shows the free end of the moveable track section 50 as it is used in the second embodiment, hooks 212' are pivotally mounted around the pin 214' and are biassed inwardly via torsion spring 194', in order that a trolley which travels to the end of the rail is captured by these hooks and is prevented from rolling off. The retraction of hooks 212' is accomplished by the interaction of stop-latch 210' with stop-block 188', in the same manner as previously discussed in the description of the first embodiment. It should be appreciated from FIG. 11, that the connection between the hooking means and the moveable rail member 50 is accomplished solely, in this case, by the use of a simple pivot pin 192'. In the second embodiment of the actuator assembly, it is not desirable to use a swivel connection between these members because there exists no inclination at the free end of the rail member as existed in the first embodiment. As has been previously mentioned, the vertical actuating assembly is displaced in a horizontal manner along with the moveable rail member 50, because the pivot pin assembly member 142' is a common pivot mechanism for both elements. Thus, the actuator can vertically displace rail member 50 while swinging in a horizontal arc. It should be appreciated that the arrangement of the pivots 142' and 72', along with the mounting of the actuator assembly 40' to the link 144', enables the moveable rail member 50 to be displaced in pure vertical and horizontal arcs, thus eliminating the development of any resultant inclination at the free end of the moveable rail member 50.

FIG. 10 shows in cut-away section, the double stroke actuator comprising an actuator cylinder structure 80', having a first cylinder 104' and a second cylinder 100', which are partitioned by boundary wall 106'. As is clear from the drawing, the first cylinder 104' is shorter in length than a second cylinder 100'. The difference in cylinder lengths allows the actuator to possess two speeds. A first slower speed, occurs when only one cylinder is being energized while a second faster speed is achieved when both cylinders are energized. Piston rod 130', corresponding to the first cylinder 104', is fixedly attached to the rear wall of the housing 11' by threaded bolt 12'. The piston 98' corresponding to the cylinder 100', is connected to piston rod 108' to therêby translate the axial motion generated by the pneumatic pressure to the torque arm and subsequently to the moveable rail 50. It should be further appreciated that, because the piston rods are respectively supported at each external end, the entire circumferentially surrounding actuator cylinder structure 80' is permitted to slide within the rectangular confines of the actuator housing 11'. By enabling the cylindrical housing to slide relative to the actuator housing, a control in the sequencing of movements between the horizontal and vertical actuators can be effected.

Figure 13:
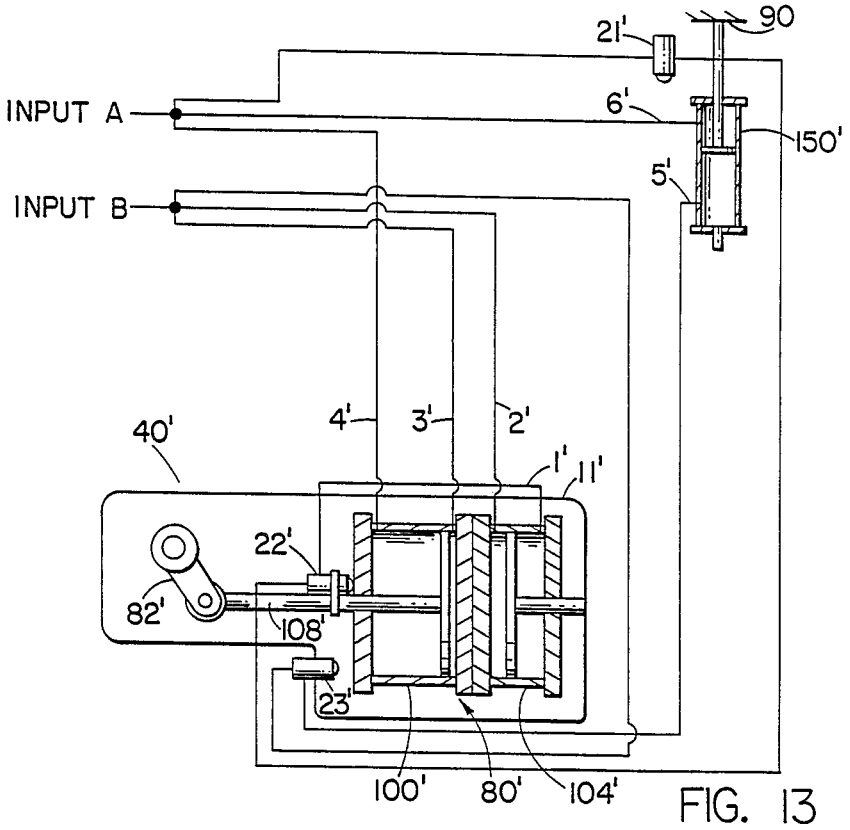
FIG. 13 is a schematic diagram of the pneumatic control system used to energize the vertical actuator and the horizontal actuator in sequence.

As best shown in FIG. 8, the sequencing of movements is controlled by three pneumatic switch valves, respectively labelled 21', 22' and 23'. Each of these valves is normally biassed outwardly, in the closed position. Valve 23' is fixedly mounted to the lower depending portion of lower housing elements 211'. Valve 22' is fixedly mounted on piston rod 108' by the support bracket 25', which threadedly engages upon piston rod 108'. Each of the valves 22' and 23', is opened by the sliding movement of the actuator cylindrical structure of actuator of 80' and are closed by the disengagement of contact therebetween. Valve 21' is mounted on an extension of frame 90 and is arranged to be in contact with the L-shaped trigger mechanism 14' mounted on the top of actuator housing 11'. Reference may now be made to the schematic of FIG. 13 illustrating the pneumatic control system used to operate the vertical actuator and horizontal actuator, in sequence. Generally, it is desirable to have the moveable rail section 50 displaced in only a vertical arc from its initial resting point, lying in line with fixed rails 52 and 54. Conversely, it is likewise desirable that the moveable rail, upon returning to its bridging position, have a final movement of only a vertical arc. The control system, shown by the schematic in FIG. 13, when connected to the appropriate nipple elements, labelled 1', 2', 3' and 4' of the dual actuator cylinder structure 80', shown in FIG. 8, and when connected to the nipple elements 5' and 6' of the horizontal actuator shown in FIG. 9, achieves the desired result of sequencing of the horizontal and vertical movements. The schematic in FIG. 13 represents two distinct flow paths which the system selectively energizes to either position the moveable rail 50, in its normal bridging state, or to lower the rail member to a point where its free end is located closely with a work station. The lines which form the branch network depending from the first input line A, represent the upward control means by which movements are sequenced. Those lines depending from input line B are the lines which control the downward sequencing of movements of the moveable rail 50. In its normal bridging position, as shown in FIG. 8, the actuator housing 11' will be in general parallel alignment with frame member 90 from which first switch 21' depends. When the moveable rail is in its normal bridging position, trigger element 14', which is mounted on the upper surface of housing 11', will be in engagement with first switch 21' to thereby open the switch. The housing assembly 11' is held in abutment against both the end of metering nut 163', as well as first switch 21', because in the normal bridging position, circuit A will always be activated, thus constantly energizing the collapsing chamber of horizontal actuator 150'. The role of switch 21' will be discussed in further detail when the behavior of the upward sequencing is described.

The general operation of the downward sequencing of movement occurs, firstly by selectively de-energizing input A and energizing input B. Once the downward controlling pneumatic circuit B is energized, the actuator extension chambers of cylinders 100' and 104' begin to fill through nipple elements 2' and 3'. Since piston 102' is fixed to the back wall of housing 11' and pneumatic fluid fills the chamber fed by nipple 2', the entire actuator cylinder structure 80' is moved to the left, thus activating switch 23'. As the cylindrical actuator structure 80 moves left it should be appreciated that, at the same time, cylinder 100' is also being filled to move the piston rod 108' leftward at a speed which is increased from what would occur where only a single chamber is energized. The movement of the piston rod 108', which occurs before switch 23' is open by contact of the actuator cylindrical structure 80', is the movement which generates the first downward arc of moveable rail 50. Once switch 23' has been contacted and opened, the expansion chamber of horizontal actuator 150' is, therefore, energized through nipple 5' to begin movement of the rail assembly from the frame 90. After the actuator cylinder structure 80' abuts switch 23' it can no longer move in a leftward manner and the pressurization of cylinder 104' is complete. However, pressurization of the larger cylinder 100' continues, so as to fully extend moveable rail 50 to its lowest desired position, while also being displaced horizontally by actuator 150'.

The actuator cylinder structure housing 80', as shown in FIG. 13, depicts the positioning of piston members within their respective cylinders when moveable rail 50 is in its normal bridging position. Thus, it should be realized that when the arm is displaced to its lower extended position, the face of the cylinder assembly will be in abuttment with switch 23' while switch 22', which is mounted on the piston rod 108', will be axially displaced with the piston rod 108', away from engagement with the left face of the cylinder assembly. Given this positioning of the valves at the lower extended position of the actuator, the sequence for accomplishing the upward movement of the arm back into its bridging position is first accomplished by selectively de-energizing circuit B and energizing circuit A. Once circuit A is energized by pressurized fluid, the collapsing chamber of horizontal actuator 150' is energized via nipple element 6'. Simultaneously, the collapsing chamber of cylinder 100' of the vertical actuator cylinder structure 80' is energized through nipple element 4' to thereby retract piston rod 108' back into the actuator cylinder.

It should be recognized that the initial movement of the arm away from the lowered work station position is both horizontal and vertical. However, the final approach of the arm into its bridging position can only be a vertical movement due to the selective sizing of the relative lengths between of cylinders of 100' and 104'. The length of cylinder 100', by itself, is not normally sized to displace piston rod 108 enough to retract or lower arm 50 totally. Total retraction or lowering is accomplished only by the combined effects of both cylinders 100' and 104'. Referring back for FIG. 13, it can be seen that switch 21' is placed in series with switch 22' and that; only upon the actuator assembly 40' being horizontally pulled into engagement with switch 21' by actuator 150', can second valve 22' be energized. Thus it should be appreciated that when valve 21' is in contact with trigger mechanism 14' switch 22' is energized. Also, at this position the moveable rail member 50 is in precise axial alignment with the ends of incoming rail 52 and outgoing rail 54, thereby necessitating only vertical movement of the arm on its final approach to the bridging position. As the collapsing chamber of cylinder 100' continues to fill with pneumatic fluid and draw the piston rod 108' to the right, switch 22' is drawn into engagement with the front face of the actuator cylinder structure housing 80' to thereby open switch 22' and energize the retracting chamber of cylinder 104' through nipple 1'. The energization of this retracting chamber therefore allows the actuator cylinder structure 80' to be slidingly moved to the right to thus effect the final vertical displacement of the moveable track into the rail gap.

Accordingly, a moveable rail section has been disclosed in a conveyorized transport apparatus for movement between a conveying position and a diverted position to facilitate work on the conveyed article and prevent interference between the article and the surrounding environment during conveying movements.

While the present invention has been described in several preferred embodiments, it should be understood that numerous modifications and substitutions can be had without departing from the spirit of the invention. For example, the actuating means utilized to divert and extend the moveable rail section may be hydraulic rather than pneumatic and the positioning of each actuator can be precisely established by closed loop control. Still other types of actuators including magnetic and electrical motors can be used. The arrangement of the pivot pins which form the pivotal connection between the stationary and moveable rails can also be changed, and in particular vertical and horizontal pivot pins can be interchanged to eliminate the slight rotation at the free end of the rail section during horizontal movement. The moveable rail section 50 is shown and described as having a pivotal connection with the incoming rail section 52, but alternatively can be pivotally connected with the outgoing rail section 54. Accordingly, the present invention has been described in several preferred embodiments by way of illustration rather than limitation.

We claim:

1. In a conveyor apparatus having a rail system for transporting a trolley and supported article from one location to another, the improvement comprising:

a moveable rail section with oppositely disposed first and second ends, a pivotal connection with an adjoining rail section at the first end, and being free for movement at the second end, the pivotal connection with the adjoining rail section permitting movement at the second, free end; and actuator means connected with the moveable rail section for powered moving of the second, free end by predetermined amounts, said moveable rail section being pivotable relative to said adjoining rail section about two separate and distinct, generally orthogonally oriented axes defining said pivotal connection, and wherein said conveyor apparatus further includes stop means adjacent the second, free end of the moveable rail section for holding a trolley and supported load for predetermined movement with the second, free end.

2. In a conveyor apparatus, the improvement of claim 1 wherein the moveable rail section is interposed between the one adjoining rail section at the first end and another adjoining rail section at the second end, and is moveable away from and back into registration with said other adjoining rail section at the second end.

3. In a conveyorized apparatus, the improvement of claim 2 further including guide means for guiding the second end of the moveable rail section into the position in registration with the other adjoining rail section.

4. The improvement of claim 1 further including another adjoining rail section registering with the second, free end of the moveable track section in a predetermined horizontal and vertical position, and release means engagable with the stop means at the second end of the moveable rail section in the predetermined position for releasing a held trolley and supported load.

5. In a conveyor apparatus, the improvement of claim 1 wherein:

the moveable rail section has a first rail portion at the first end and a second rail portion at the second end with a longitudinal axis extending between the two portions, and the two rail portions are moveable longitudinally relative to one another to extend and retract the moveable longitudinally rail section; and another actuator means is connected with the first and second rail portions of the moveable rail section for extending and retracting the rail section.

6. In a conveyorized apparatus as defined in claim 1, the improvement wherein:

an end portion of the moveable rail section at the second free end is pivotable about a generally horizontal axis transverse to a longitudinal rail axis; and means are connected with the pivotable end portion of the moveable rail section to maintain the end portion in a generally horizontal position.

7. In a conveyor apparatus the improvement of claim 1 wherein said actuator means comprises vertical actuator means for moving said moveable rail section in a vertical plane and horizontal actuator means for moving said moveable rail section in a horizontal plane.

8. In a conveyor apparatus the improvement of claim 7 wherein said vertical actuator means is pivotally mounted with said moveable rail section and said horizontal actuator means horizontally moves both the rail section and the vertical actuator means together with one another whereby said second free end of the moveable rail pivots with respect to said axes without resulting in an inclination of said second free end relative to a vertically depending plane.

9. In a conveyor apparatus the improvement of claim 8 wherein said pivotal connection further includes a pivot link having a lower extending portion for securing the vertical actuator means to the moveable rail section such that the vertical actuator and the moveable rail section move horizontally together with one another.

10. In a conveyor apparatus the improvement of claim 9 wherein said lower extending portion further connects said horizontal actuator means with said moveable rail section.

11. In a conveyor apparatus the improvement of claim 10 wherein said horizontal actuator means includes momentum absorbing means for absorbing the momentum of the moveable rail and the mounted vertical actuator as both swing to a stop and horizontal limiting means for selectively adjusting the horizontal displacement of said vertical actuator means and said moveable rail away from and towards the rail system.

12. A conveyorized transport apparatus for moving articles supported by a trolley along a rail system to and from a work station comprising:

an incoming rail section on which trolleys and supported articles approach the work station;

an outgoing rail section on which trolleys and supported articles depart from the work station;

a moveable rail section pivotally connected at one end with one of the other rail sections for movement between a conveying position for transferring the trolley and load between the incoming and outgoing rail sections, and a diverted position for locating the trolley and supported load closer to the work station than in the conveying position; and actuating means for pivoting the moveable rail section between the conveying and diverted positions, said moveable rail section being pivotable about two generally orthogonal axes relative to said one of the other rail sections.

13. A transport apparatus as defined in claim 12 wherein:

the moveable rail section is adjustable in length; and means are provided for adjusting the length of the moveable rail section.

14. A transport apparatus as defined in claim 12 further including stop means connected with the moveable rail section at the end opposite the end pivotably connected with one of the other rail sections.

15. In a conveyor apparatus, having a rail system for transporting a trolley and supported article from one location to another, the improvement comprising:

a moveable rail section with oppositely disposed first and second ends, a pivotal connection with an adjoining rail section at the first end, and being free for movement at the second end, the pivotal connection with the adjoining rail section permitting movement at the second, free end; and actuator means connected with the moveable rail section for powered moving of the second, free end by predetermined amounts, said moveable rail section being pivotable relative to said adjoining rail section about two separate and distinct, generally orthogonally oriented axes defining said pivotal connection, and wherein said pivotal connection includes a pivot link having a vertically disposed pivot axis at one end being defined by a vertically oriented pivot pin connecting said link to said adjoining rail; and said link having a horizontally disposed pivot axis at its other, opposite end being defined by a horizontally oriented pivot pin connecting said link with said moveable rail section first end.

16. In a conveyor apparatus, having a rail system for transporting a trolley and supported article from one location to another, the improvement comprising:

a moveable rail section with oppositely disposed first and second ends, a pivotal connection with an adjoining rail section at the first end, and being free for movement at the second end, the pivotal connection with the adjoining rail section permitting movement at the second, free end; and actuator means connected with the moveable rail section for powered moving of the second, free end by predetermined amounts, said moveable rail section being pivotable relative to said adjoining rail section about two separate and distinct, generally orthogonally oriented axes defining said pivotal connection, and wherein said pivotal connection includes a pivot link having a horizontally disposed pivot axis at one end being defined by a horizontally oriented pivot pin connecting said link to said adjoining rail; and said link having a vertically disposed pivot axis at its other, opposite end being defined by a vertically oriented pivot pin connecting said link with said moveable rail section first end.

* * * * *